US006006365A

United States Patent [19]

Strandberg

[11] Patent Number: 6,006,365

[45] Date of Patent: Dec. 28, 1999

[54] SUSPENDER KIT AND METHOD FOR SUPPORTING A PAIR OF TROUSERS OR PANTS

[76] Inventor: Eskil E. Strandberg, Pollard Pl., Box 28, Quesnel, British Columbia, Canada, V2J 5E6

[21] Appl. No.: 09/203,502

[22] Filed: Dec. 1, 1998

[51] Int. Cl.[6] ..... A41F 15/00

[52] U.S. Cl. ..... 2/329; 2/310; 2/340; 2/227; D2/626

[58] Field of Search ..... 2/329, 326, 327, 2/328, 336, 310, 338, 340, 227; 182/3–5, 7; 244/151 R; 482/24, 43, 69; 602/19; 128/99.1, 100.1, 102.1; D2/626, 624, 629; D29/100, 101

[56] References Cited

U.S. PATENT DOCUMENTS

| | | | |
|---|---|---|---|
| 34,094 | 10/1892 | Grilliot . | |
| 3,784,987 | 1/1974 | Bryant . | |
| 4,481,682 | 11/1984 | Hall . | |
| 4,850,057 | 7/1989 | Schierenbeck . | |
| 4,858,249 | 8/1989 | Stewart . | |
| 4,934,297 | 6/1990 | Long | 114/39.2 |
| 5,036,549 | 8/1991 | Jackson . | |
| 5,197,931 | 3/1993 | Wroclawsky | 482/74 |
| 5,488,738 | 2/1996 | Seamans | 2/69 |
| 5,531,292 | 7/1996 | Bell . | |
| 5,564,131 | 10/1996 | Anscher | 2/340 |
| 5,623,735 | 4/1997 | Perry . | |
| 5,695,432 | 12/1997 | Soderlund | 482/69 |
| 5,774,899 | 7/1998 | Griffin . | |
| 5,927,438 | 7/1999 | Ostrobrod | 182/241 |

FOREIGN PATENT DOCUMENTS

| | | |
|---|---|---|
| 688819 | 9/1937 | Germany . |
| 10277096 | 10/1998 | Japan . |

*Primary Examiner*—Gloria M. Hale
*Assistant Examiner*—Tejash Patel
*Attorney, Agent, or Firm*—Elbie R. de Kock

[57] ABSTRACT

A kit for supporting a pair of trousers on a wearer's body comprises a plurality of connectors for connection to the upper part of the trousers at two pairs of spaced locations at the front and rear of the trousers. The kit also includes a belt for attachment to the connectors such that the belt extends from the one of the connectors in the front of the trousers upwards along the wearer's chest and over the wearer's shoulder down the wearer's back and connected to one of the connectors at the rear of the trousers and extending along the wearer's back towards and connected to the second one of the connectors at the rear of the trousers. The belt then extends upwardly along the wearer's back and over the wearer's other shoulder down the wearer's chest towards and connected to the other one of the connectors at the front of the trousers. A method for supporting a pair of trousers on a wearer's body is also provided.

31 Claims, 8 Drawing Sheets

SUSPENDER KIT AND METHOD FOR SUPPORTING A PAIR OF TROUSERS OR PANTS

FIELD OF THE INVENTION

This invention relates to a suspender kit for supporting a pair of trousers or pants on a wearer's body. It also relates to a method of supporting a wearer's trousers or pants.

BACKGROUND OF THE INVENTION

Suspenders are used as an alternative to wearing a belt and in some respects are becoming more popular or fashionable. One problem with wearing suspenders is that they do not tighten the trousers around the waist. Another problem is that the suspenders can feel uncomfortable or constraining since in some respects they do not conform to body movement and they are required to support the full weight of the trousers.

It is accordingly an object of the present invention to alleviate the above-mentioned difficulties.

SUMMARY OF THE INVENTION

According to the invention there is provided a method of supporting a pair of trousers on a wearer's body, the trousers having connectors at four circumferentially spaced locations around the upper part of the trousers, two of the connectors being located at the front and two of the connectors being located at the rear of the trousers, comprising the steps of attaching a continuous belt to said connectors, characterized in that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

The connectors may comprise belt loops which are attached to the trousers or holes which are provided in the trousers.

Also according to the invention there is provided a method of supporting a pair of trousers on a wearer's body, comprising the steps of attaching connectors to the upper part of the trousers at four circumferentially spaced locations, two of the connectors being located at the front and two at the rear of the trousers and attaching a belt to said connectors, characterized in that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

At least one but preferably all the connectors, may comprise a wheel which is rotatably attached to the trousers, the belt being supported on the circumference of the wheels.

Also according to the invention there is provided a kit for supporting a pair of trousers on a wearer's body, comprising a plurality of connectors for connection to the upper part of the trousers at two pairs of spaced locations at the front and rear of the trousers and a belt for attachment to the connectors such that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

The belt may be of an elastic material such as a flexible tube or band, or it may be of a material, which although flexible, is not stretchable or deformable in a longitudinal direction, such as a rope.

Each or all of the connectors may have a belt attachment end, a trousers attachment end and a longitudinal axis extending from the belt attachment end to the trousers attachment end, wherein the said ends are rotatable relative to each other about said axis.

Further objects and advantages of the invention will become apparent from the description of preferred embodiments of the invention below.

BRIEF DESCRIPTION OF THE DRAWINGS

The invention will now be described, by way of examples, with reference to the accompanying drawings, in which.

DETAILED DESCRIPTION OF PREFERRED EMBODIMENTS

Figure 1:
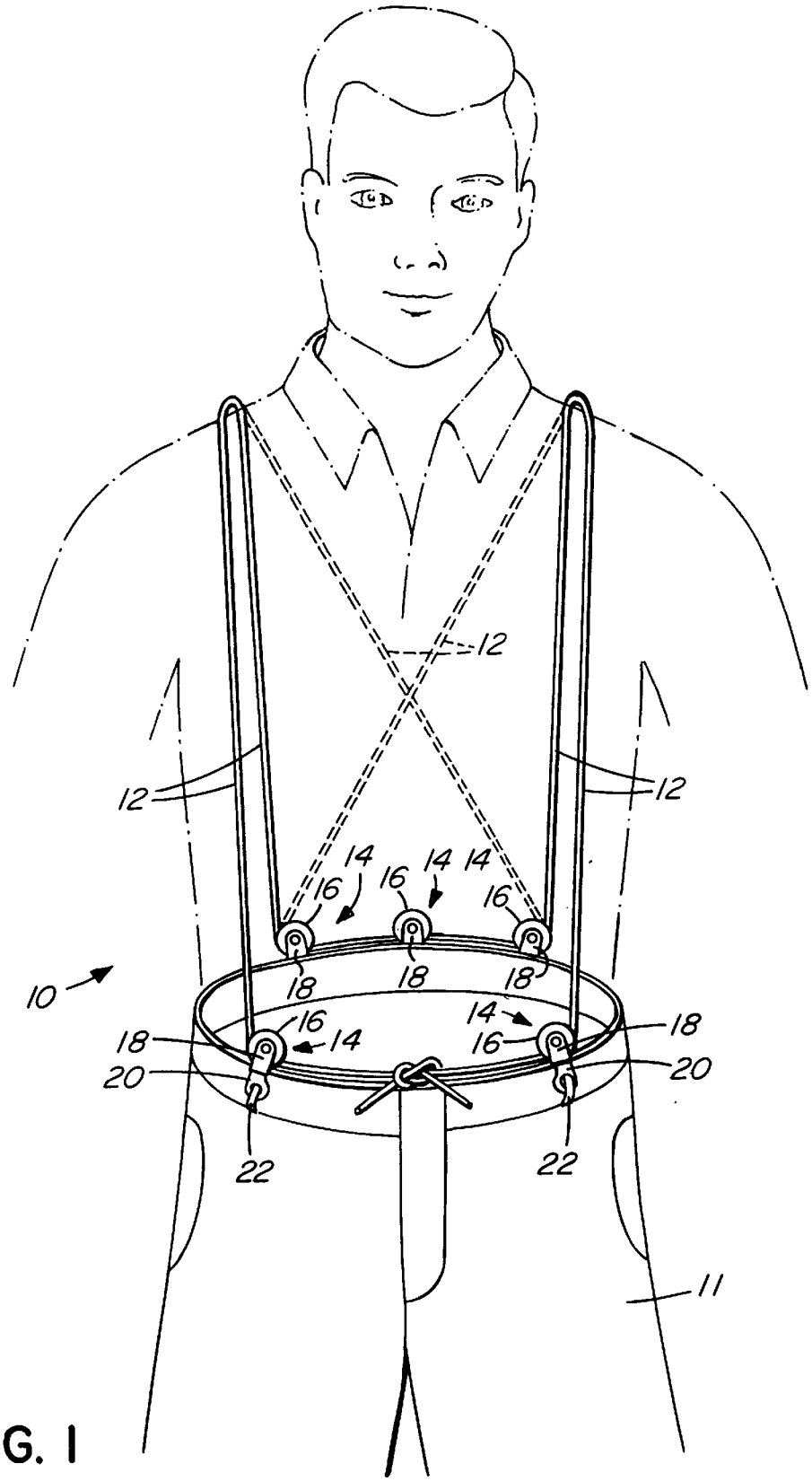
FIG. 1 is a schematical illustration of a suspender kit which comprises a set of connectors incorporating rotatable wheels supporting a suspender belt, shown as worn by a male wearer.

In FIG. 1, reference numeral 10 generally indicates a suspender kit which comprises a suspender belt 12 and a set of five connectors 14.

Figure 5:
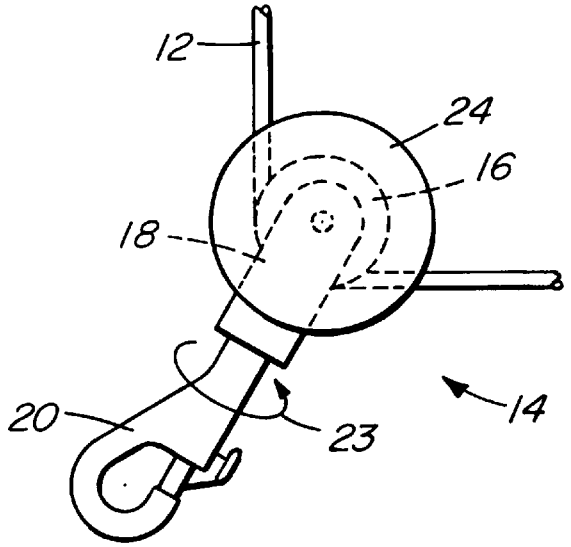
FIG. 5 is a front view of a connector of a suspender kit.
Figure 6:
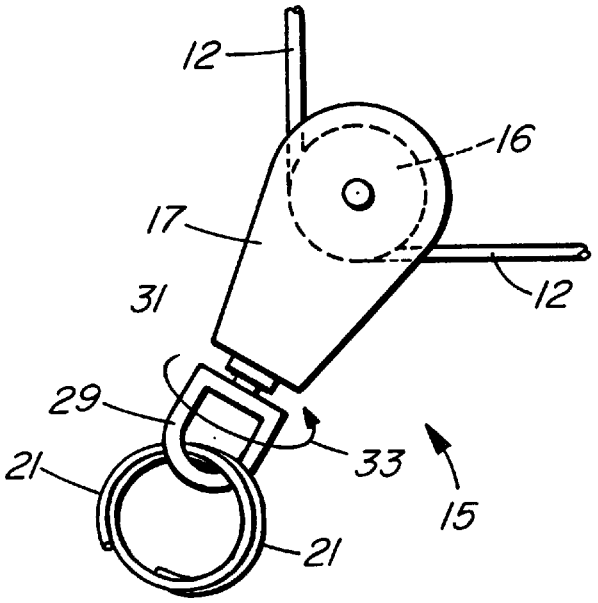
FIG. 6 is a front view of a different connector.
Figure 8:
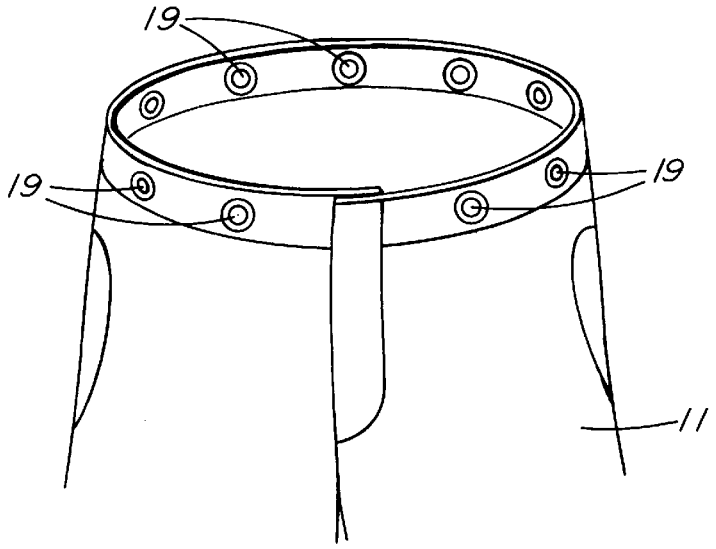
FIG. 8 is a three-dimensional view of the upper part of a pair of trousers provided with a series of circumferentially spaced holes for use with the suspender kits of FIGS. 1 to 4.

The connectors 14 each comprise a wheel 16 which is rotatably mounted on a coupling member 18 which is attached to the top part of a pair of trousers or pants 11 in any convenient fashion, eg. by means of a clip (not shown) which clips onto the upper rim of the trousers 11, such as used with a pair of conventional suspenders, or as in the illustrated example, having a hook 20 (such as a spring loaded bullet catch hook as shown in FIG. 5 or a key ring 21, as shown in FIG. 6) which engages with a belt loop 22 provided on the trousers 11. Alternatively, the hook 20 may be engaged with a hole 19 provided for this purpose in the trousers 11. Several of the holes 19 may be provided spaced around the upper circumference of the trousers, as shown in FIG. 8. This also provides for flexibility as to the locations on the trousers 11 where the connectors 14 can be attached.

As shown, two of the connectors 14 are attached to the front of the trousers 11 and three are attached to the rear of the trousers 11. If desired, the central connector 14 at the rear of the trousers may be omitted so that there is a pair of the connectors 14 at the front and a pair of the connectors 14 at the rear of the trousers 11.

In FIG. 1, the outline of the wearer is shown in broken lines.

Figure 7:
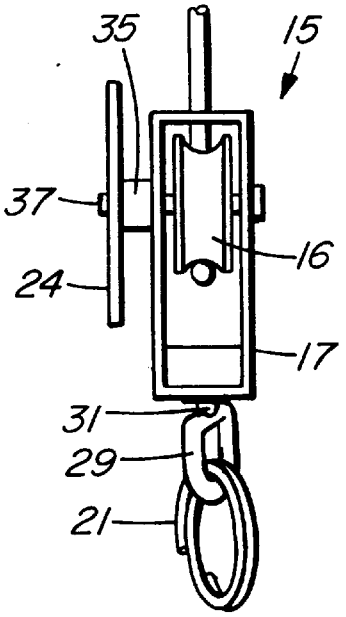
FIG. 7 is a side view of the connector of FIG. 5.

The belt 12 extends around the one connector 14 in the front of the trousers, upwards along the wearer's chest and over the shoulder down the wearer's back, around the connectors 14 at the back of the trousers and upwards along the wearer's back and over the other shoulder down along the wearer's chest and around the other connector 14 at the front of the trousers 11. The wheels 16 are like pulleys (as shown in FIG. 7) and have a circumferential recess for receiving the belt 12 which has a circular cross section for this purpose.

The belt 12 may be arranged so that it runs from the front connector 14 to the corresponding connector 14 on the same side of the wearer, as shown in solid lines in FIG. 1 or the belt 12 may be crossed over at the back of the wearer, as shown in broken lines.

The free ends of the belt 12 are tied together at the front of the trousers 11, as shown. Alternatively, they may be connected together by any other suitable means, such as a buckle.

Figure 2:
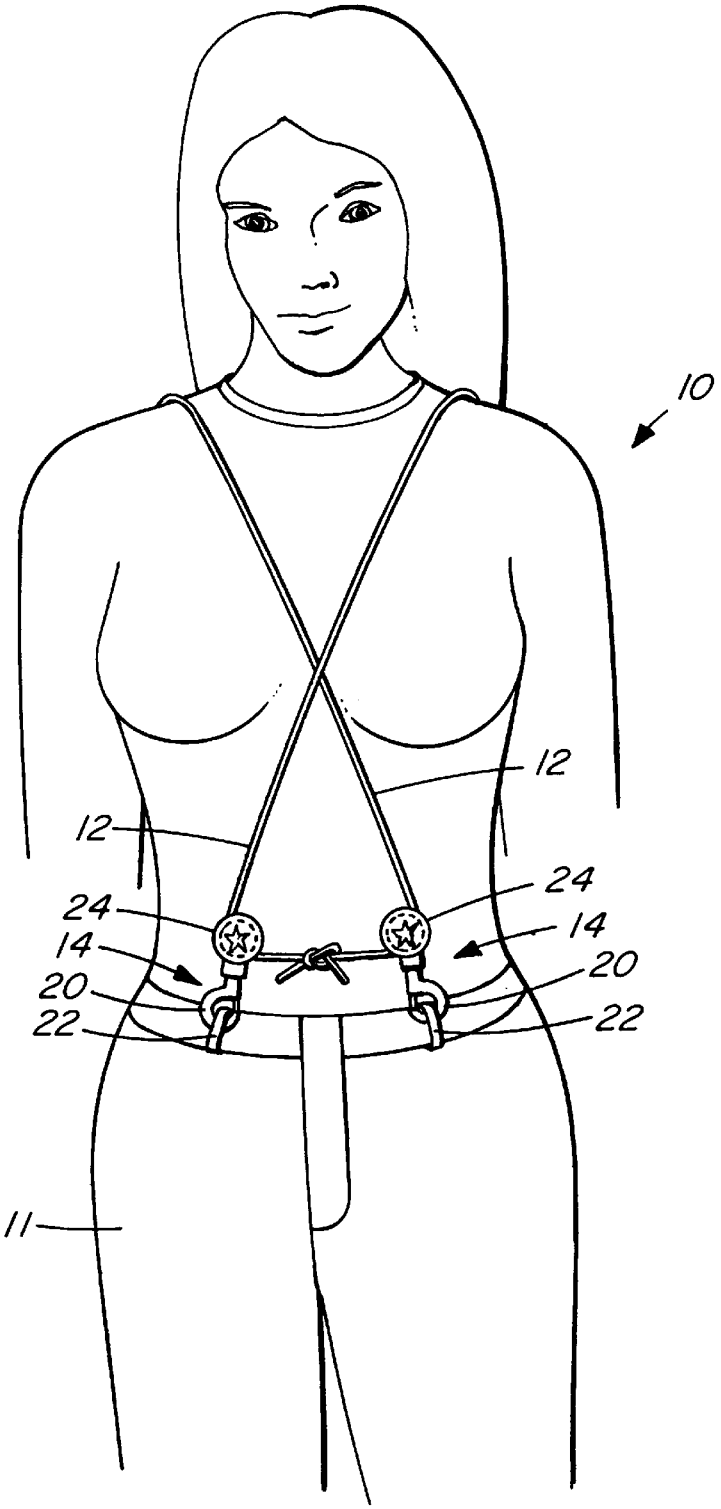
FIGS. 2 and 3, respectively, are front and rear views of a female wearing a suspender kit comprising a set of connectors incorporating rotatable wheels supporting a suspender belt.
Figure 3:
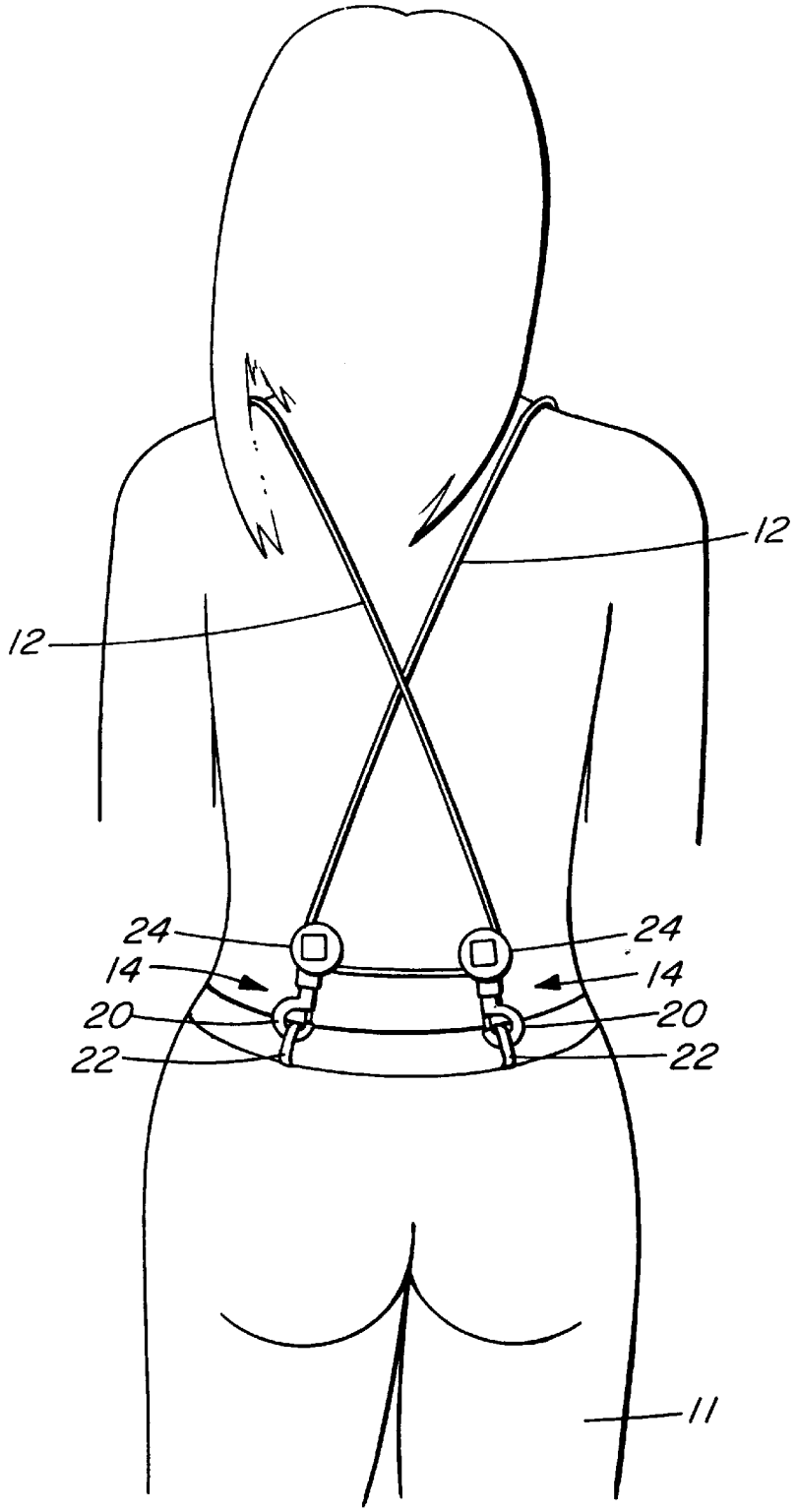

In FIGS. 2 and 3 the suspender kit 10 is shown worn by a female wearer. In this example, the belt 12 is crossed over at the front and the back of the wearer.

Figure 13:
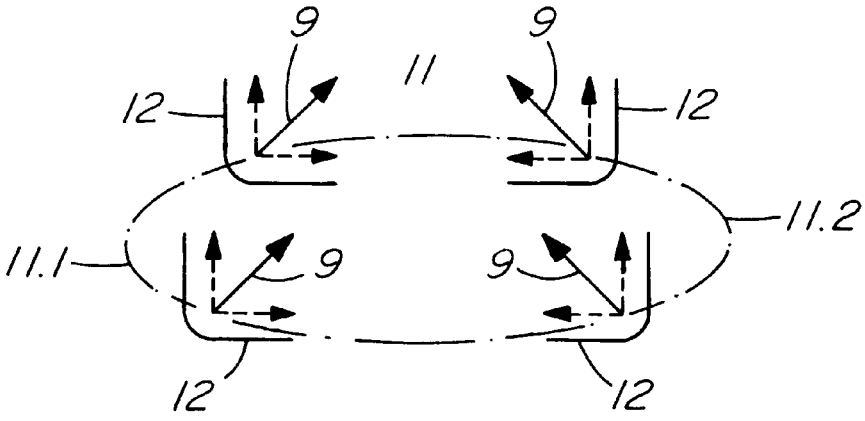
FIG. 13 is a schematical diagram illustrating the operation of the suspender kit according to the invention.

The belt 12 which extends like a pair of suspenders over the wearer's shoulders, supports the trousers or pants 11. In addition, the belt 12 which also extends partially around the wearer's body in the front and back of the wearer has the effect of tightening the trousers around the wearer's waist. This aspect is illustrated in FIG. 13. As indicated by the arrows 9 the belt 12 exerts diagonally directed forces on the pants 11. The exact direction of the force vectors 9 will of course depend on whether the belt 12 is crossed over or not, as well as the locations of attachment to the pants 11. Each diagonal force vector 9 has a vertical component and a horizontal component (shown in broken lines). If the diagonal force vectors 9 extend at an angle of 45° then the vertical and horizontal vectors will, for example, each comprise 50% of the total force. However, this ratio can be varied as desired.

The horizontal force components serve to pull the opposite sides 11.1 and 11.2 of the pants 11 towards each other, thereby acting as a belt to relieve some of the weight of the pants 11, while the vertical components act to lift the pants 11 to support some of the weight. Therefore, the vertical and horizontal forces act in conjunction to provide the benefits of both a belt and suspenders.

As indicated by the arrow 23 in FIG. 5, the hook 20 is rotatably connected to the coupling member 18, ie. it can swivel about the longitudinal axis of the hook 20. This is an axis which is perpendicular to the axis of rotation of the wheel 16.

Figure 4:
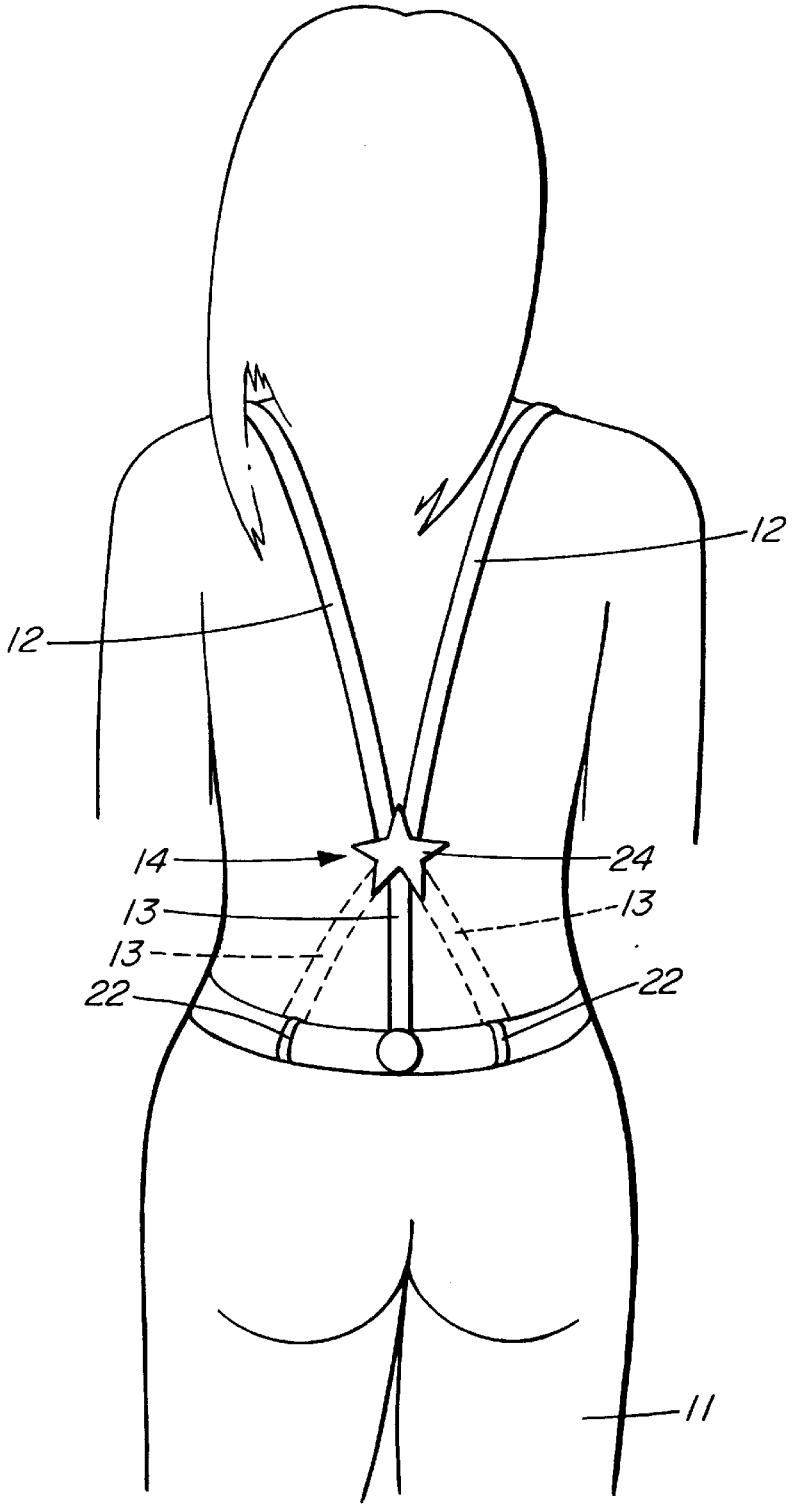
FIG. 4 is a rear view of a female wearing a suspender kit according to another embodiment of the invention.

An alternative embodiment is shown in FIG. 4, in which there is a single connection at the back of a wearer. As shown, a single connector 14 is provided with the belt 12 extending around the wheel 16 of the connector 14. (In FIG. 4, the connector 14 is obscured by a star-shaped decorative disc 24, as will be described below). The connector 14 is attached to the pants 11 by means of a single connection strip 13 or a pair of connection strips 13 (shown in broken lines). The connection strip 13 can be connected to the pants 11 in any convenient fashion, such as a clip, hook or button.

In FIGS. 6 and 7 an alternative type of connector 15 is shown. The connector 15 also comprises a wheel or pulley 16 for supporting the belt 12. The pulley 16 is rotatably mounted in a cage 17. In place of the hook 20, the connector 15 comprises a key ring 21 for connection to the belt loop 22 on the trousers or connected to a hole 19 provided in the top of the trousers 11.

The key ring 21 is attached to a key ring holder 29 which is attached to the cage 17 for rotation about an axle 31, as indicated by the arrows 33 in FIG. 6. In this way, the key ring holder 29 is capable of swivelling movement about an axis which is perpendicular to the axis of rotation of the pulley 16.

Since the wheels 16 are free to rotate, they allow for longitudinal movement of the belt 12 so that it can react or adjust to body movement, such as during walking. This is further enhanced by the capability of swivelling movement about the axes which are perpendicular to the rotation axes of the wheels 16. This effect may be particularly desirable for a female wearer, as portrayed by FIGS. 2 and 3. In this way, when she is walking, the suspenders will move with her and the pulleys 16 swivel to accentuate her body movement.

For the purposes of fashion or to set a trend, the connector 14,15 may be provided with decoration. For example, as shown in FIGS. 2 to 5 and 7, the connector 14,15 is provided with a disc 24 which covers the wheel 16. A design, pattern or other decoration can be provided on the disc 24, such as a star, as shown in FIG. 2 or a cube as shown in FIG. 3. The disc 24 may itself have an ornamental shape, e.g., it may be star-shaped in outline, as shown in FIG. 4.

The disc 24 may conveniently be attached to the connector 14,15 by means of a magnet 35, as shown in FIG. 7. For further effect, the disc 24 is rotatable about an axle 37 on the magnet 35.

Figure 9:
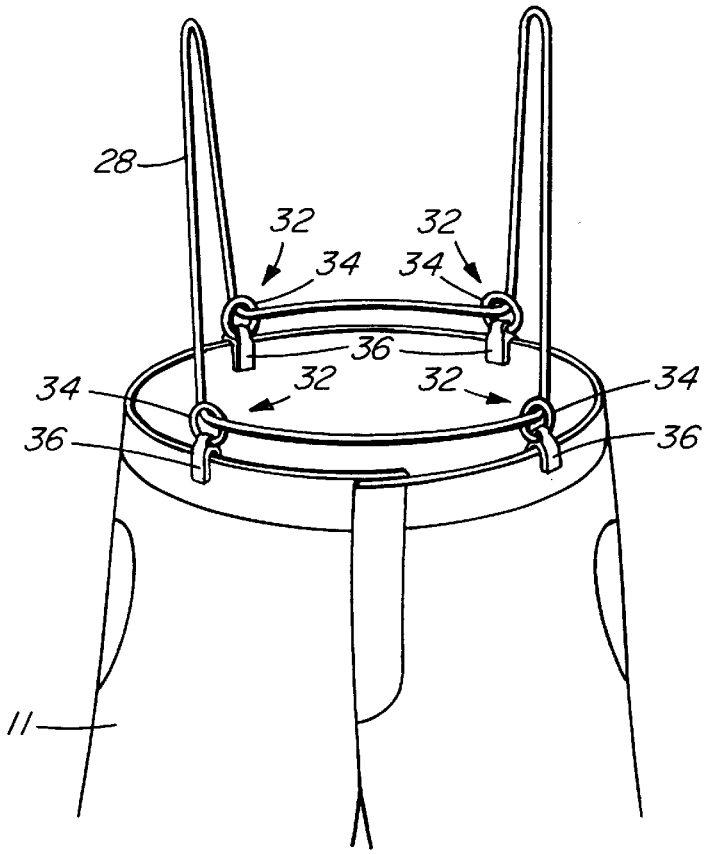
FIG. 9 is a schematical illustration of a suspender kit which comprises a set of connectors incorporating rings to which an elastic suspender belt is attached.

In FIG. 9, reference numeral 30 generally indicates another embodiment of a suspender kit.

The kit 30 comprises an elastic belt 28 and a set of four connectors 32, each comprising a ring 34 which is attached to the top of the trousers 11 by means of clips 36, similar to the type of clip used with conventional suspenders, or any other suitable means, such as hook 20 or keyring 21, shown in FIGS. 5 and 6, respectively.

The belt 28 is attached to the rings 34 and extends over the shoulders and along the front and rear, as in the case of the belt 12 in FIG. 1. If desired, it may be crossed over in the front or back, as is the case with FIGS. 1 to 3. In this case, the belt 28 may simply be threaded through the rings 34 so that it is capable of longitudinal movement relative to the rings 34 or (as shown in the present example) it may be tied to the rings 34 so that it is not capable of movement relative to the rings 34, except for stretching action due to its elasticity.

Figure 10:
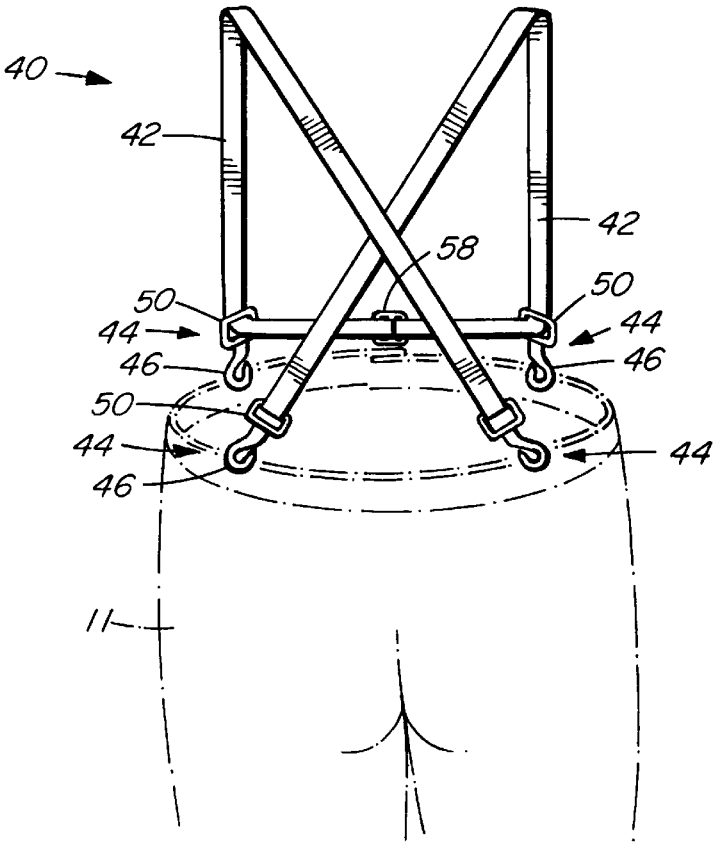
FIG. 10 is a three-dimensional rear view of a suspender kit according to another embodiment of the invention.

Referring now to FIG. 10, reference numeral 40 generally indicates a suspender kit according to another embodiment of the invention. The kit 40 comprises an elastic belt 42 in the form of a flat band of about one inch width in the present example, and a set of four connectors 44 for attaching the belt 42 to a pair of trousers 11.

Figure 11:
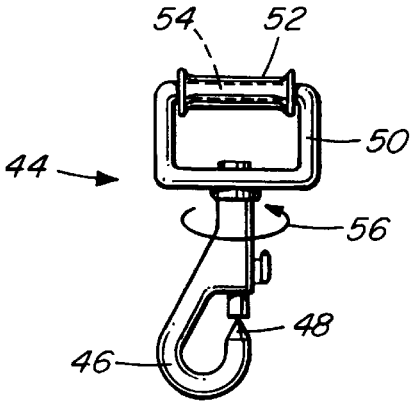
FIG. 11 is a side view of a connector of the suspender kit of FIG. 10.
Figure 12:
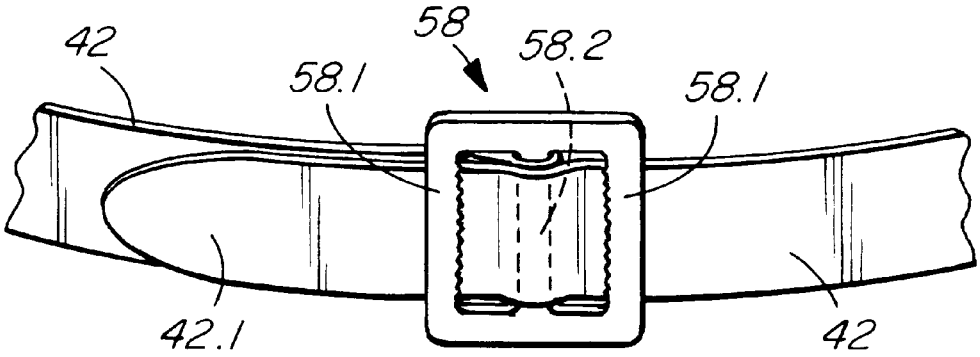
FIG. 12 is a partial view of the suspender belt of the suspender kit of FIG. 10, showing an adjustment buckle on the suspender belt.

Each connector 44 (see FIG. 11) comprises a hook 46, similar to the spring loaded bullet catch hook 20 of FIG. 5, except that it is provided with a pointed end 42 for easy attachment to the trousers 11, without the need of a hole 19 or belt loops 22. The connector 44 is also provided with a coupling member 50 which is wide enough to receive the belt 42. The coupling member 50 is provided with a roller 52 for supporting the belt 42 and to facilitate easy movement of the belt 42 relative to the member 50. However, the member 50 may be used without the roller 52 so that the belt will simply slide over the cross bar 54. As indicated by the arrows 56, the hook 46 is capable of rotational movement relative to the member 50 about an axis which is perpendicular to the rotation axis of the roller 52.

As shown, the belt 42 is crossed over at the back. In the front the belt 42 is provided with an adjustment buckle 58, which has two toothed side bars 58.1 and a central bar 58.2. The one end of the belt 42 is attached to the central bar 58.2, while the other end extends between the toothed side bars 58.1 and the central bar 58.2. This end of the belt 42 has a free end 42.1 which extends beyond the buckle 58. If desired one or more of the buckles 58 may be provided on any other part of the belt 42, eg. on the front parts running down a wearer's chest, for easy height adjustment, as in the case of a conventional pair of suspenders.

While only preferred embodiments of the invention have been described herein in detail, the invention is not limited thereby and modifications can be made within the scope of the attached claims.

What is claimed is:

1. A method of supporting a pair of trousers on a wearer's body, the trousers having connectors at four circumferentially spaced locations around the upper part of the trousers, two of the connectors being located at the front and two of the connectors being located at the rear of the trousers, comprising the steps of attaching a continuous belt to said connectors, characterized in that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

2. The method according to claim 1, wherein the connectors comprise belt loops which are attached to the trousers.

3. The method according to claim 1, wherein the connectors comprise holes in the trousers.

4. The method according to claim 1, wherein the belt is of an elastic material.

5. The method according to claim 1, wherein the belt is connected to the connectors in such a fashion that it has a free end extending from each of said connectors in the front part of the trousers, and further comprising the step of connecting said free ends together.

6. A method of supporting a pair of trousers on a wearer's body, comprising the steps of:

attaching connectors to the upper part of the trousers at four circumferentially spaced locations, two of the connectors being located at the front and two at the rear of the trousers; and attaching a belt to said connectors, characterized in that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

7. The method according to claim 6, wherein the connectors have a belt attachment end, a trousers attachment end and a longitudinal axis extending from the belt attachment end to the trousers attachment end and wherein the said ends are rotatable relative to each other about said axis.

8. The method according to claim 6, wherein the belt is connected to the connectors in such a fashion that it has a free end extending from each of said connectors at the front of the trousers, and further comprising the step of connecting said free ends together.

9. The method according to claim 6, wherein the belt is of an elastic material.

10. The method according to claim 6, wherein the connectors each comprise a ring to which the belt is attached.

11. The method according to claim 6, wherein at least one of the connectors comprises a wheel which is rotatably attached to the trousers and the belt is supported on the circumference of the wheel.

12. The method according to claim 6, wherein the connectors at the front of the trousers each comprises a wheel which is rotatably attached to the trousers and the belt is supported on the circumference of the wheels.

13. The method according to claim 6, wherein the connectors at the rear of the trousers each comprises a wheel which is rotatably attached to the trousers and the belt is supported on the circumference of the wheels.

14. The method according to claim 10, wherein the belt has a substantially circular cross-section and the wheel has a circumferential recess for receiving the belt.

15. The method according to claim 10, wherein the belt is in the form of a flat band and the wheel is in the form of a roller to support the band.

16. The method according to claim 10, wherein the connectors are provided with decorative members on outwardly facing sides thereof.

17. The method according to claim 16, wherein the decorative members are rotatably attached to the connectors.

18. The method according to claim 6, wherein a third connector is attached to the rear of the trousers in between said other two connectors.

19. A kit for supporting a pair of trousers on a wearer's body, comprising:

a plurality of connectors for connection to the upper part of the trousers at two pairs of spaced locations at the front and rear of the trousers; and a belt for attachment to the connectors such that the belt extends from the one of said connectors in the front of the trousers upwards along the wearer's chest and over the wearer's shoulder down the wearer's back and connected to the one of said connectors at the rear of the trousers and extending along the wearer's lower back towards and connected to the second one of said connectors at the rear of the trousers and extending upwardly along the wearer's back and over the wearer's other shoulder down the wearer's chest towards and connected to the other one of said connectors at the front of the trousers.

20. The kit according to claim 19, wherein the connectors have a belt attachment end, a trousers attachment end and a longitudinal axis extending from the belt attachment end to the trousers attachment end and wherein the said ends are rotatable relative to each other about said axis.

21. The kit according to claim 19, wherein the belt has a pair of ends extending from each of said connectors at the front of the trousers and further comprising means for connecting the free ends to each other.

22. The kit according to claim 19, wherein the belt is of an elastic material.

23. The kit according to claim 19, wherein the connectors each comprise a ring to which the belt is attached.

24. The kit according to claim 19, wherein each connector includes a rotatably mounted wheel for supporting the belt on its circumference.

25. The kit according to claim 24, wherein the belt has a circumferential cross-section and each wheel has a circumferential recess for receiving the belt.

26. The kit according to claim 24, wherein the belt is in the form of a flat band and the wheel is in the form of a roller to support the band.

27. The kit according to claim 19, wherein the connectors are provided with decorative members thereon.

28. The method according to claim 27, wherein the decorative members are rotatably attached to the connectors.

29. The kit according to claim 19, further comprising a fifth connector for attachment to the rear of the trousers in between said other two connectors.

30. A kit for supporting a pair of trousers on a wearer's body, comprising:

a plurality of connectors for connection to the upper part of the trousers at two circumferentially spaced locations at the front of the trousers and one location at the rear of the trousers; and a belt for attachment to the connectors such that the belt extends from the one of said connectors in the front of the trousers upwards along the wearer's chest and over the wearer's shoulder down the wearer's back and connected to the connector at the rear of the trousers and extending upwardly along the wearer's back and over the wearer's other shoulder down the wearer's chest towards and connected to the other one of said connectors at the front of the trousers, and wherein the belt further extends between the two connectors at the front of the trousers.

31. A method of supporting a pair of trousers on a wearer's body, comprising the steps of:

attaching connectors to the upper part of the trousers at two circumferentially spaced locations at the front of the trousers and one location at the rear of the trousers; and attaching a belt to said connectors, characterized in that the belt extends from the one of said connectors in the front of the trousers upwards along the wearer's chest and over the wearer's shoulder down the wearer's back and connected to the one of said connectors at the rear of the trousers and extending upwardly along the wearer's back and over the wearer's other shoulder down the wearer's chest towards and connected to the other one of said connectors at the front of the trousers and wherein the belt further extends between the two connectors at the front of the trousers.

* * * * *